US008453877B2

(12) United States Patent
Ionidis

(10) Patent No.: US 8,453,877 B2
(45) Date of Patent: Jun. 4, 2013

(54) AUTOMATIC FLUID DISPENSER WITH INSTRUCTIONAL OUTPUT

(75) Inventor: Georgios Ionidis, Zürich (CH)

(73) Assignee: Oro Clean Chemie AG, Fehraltorf (CH)

( * ) Notice: Subject to any disclaimer, the term of this patent is extended or adjusted under 35 U.S.C. 154(b) by 412 days.

(21) Appl. No.: 12/677,041

(22) PCT Filed: Sep. 2, 2008

(86) PCT No.: PCT/CH2008/000363

§ 371 (c)(1),
(2), (4) Date: Jul. 6, 2010

(87) PCT Pub. No.: WO2009/033301

PCT Pub. Date: Mar. 19, 2009

(65) Prior Publication Data

US 2010/0282772 A1 Nov. 11, 2010

(30) Foreign Application Priority Data

Sep. 10, 2007 (EP) ..... 07405271

(51) Int. Cl.

| | |
|---|---|
| ***B67D 7/06*** | (2010.01) |
| ***B67D 7/56*** | (2010.01) |
| ***B67D 1/00*** | (2006.01) |
| ***B67D 7/14*** | (2010.01) |
| ***G08B 13/14*** | (2006.01) |

(52) U.S. Cl.
USPC ..... 222/1; 222/23; 222/39; 222/52; 222/63; 340/572.1

(58) Field of Classification Search
USPC ..... 222/23, 52, 63, 1, 39; 340/573.1, 340/603; 434/428
See application file for complete search history.

(56) References Cited

U.S. PATENT DOCUMENTS

| | | | | |
|---|---|---|---|---|
| 2,605,021 | A * | 7/1952 | Churchill et al. | 222/153.03 |
| 6,068,162 | A * | 5/2000 | De Winter et al. | 222/181.3 |
| 6,236,317 | B1 | 5/2001 | Cohen et al. | |
| 6,375,038 | B1 * | 4/2002 | Daansen et al. | 222/52 |
| 7,028,861 | B2 * | 4/2006 | Sayers et al. | 222/1 |
| 7,236,936 | B2 * | 6/2007 | White et al. | 705/3 |
| 7,367,477 | B2 * | 5/2008 | Ophardt et al. | 222/181.3 |
| 2005/0127090 | A1 | 6/2005 | Sayers et al. | |
| 2005/0280964 | A1 * | 12/2005 | Richmond et al. | 361/62 |
| 2007/0080815 | A1 * | 4/2007 | Steinmetz | 340/573.1 |
| 2007/0181602 | A1 * | 8/2007 | Taradalsky | 222/152 |

OTHER PUBLICATIONS

European Computer Manufacturers Association, ECMA Standard for Data Interchange on Punched Tape, Nov. 1965.*

* cited by examiner

*Primary Examiner* — Kevin P Shaver
*Assistant Examiner* — Matthew Lembo
(74) *Attorney, Agent, or Firm* — Birch, Stewart, Kolasch & Birch, LLP

(57) ABSTRACT

The invention relates to an automatic dispenser for dispensing a fluid and for instructing a user, comprising a) a holder device for a replaceable fluid container, wherein the holder device has a sensor for reading an identification of the replaceable fluid container, b) a delivery device, which enables a dispensing of a fluid from the fluid container, c) one or more touchless proximity sensors for detecting a hand of a user, d) an output device for the time-controlled output of a plurality of visual and/or sound-based instructions of a sequence of instructions to the user, and e) a controller having at least one data memory, wherein in a first data memory sequences of instructions associated with multiple and different replaceable containers and/or the identifications thereof are stored.

29 Claims, 8 Drawing Sheets

AUTOMATIC FLUID DISPENSER WITH INSTRUCTIONAL OUTPUT

TECHNICAL FIELD

The invention relates to an automatic dispenser for dispensing a liquid and for instructing a user, comprising a receiving device for a replaceable liquid container, wherein the receiving device has a sensor for reading an identification of the replaceable liquid container, a delivery device, which permits dispensing of a liquid from the liquid container, one or more non-contact proximity detectors for detecting a hand of the user, wherein the proximity detector is provided for initiating the dispensing of the liquid, an output device for time-controlled output of a plurality of visual and/or sound-based instructions of a sequence of instructions to the user, and a control unit with at least one data memory, wherein the control unit is connected to the proximity detector, to the output device and to the sensor for identification of the replaceable container, and wherein a first data memory stores several sequences of instructions associated with different replaceable containers and/or with the identification thereof. The invention further relates to a method for dispensing a liquid from a replaceable liquid container and for instructing a user using an automatic dispenser, wherein a proximity detector detects a hand of the user and then initiates the dispensing of the liquid, and an identification of the replaceable liquid container is read via a sensor.

PRIOR ART

In all areas of human and veterinary medicine, and also in the food industry or pharmaceutical industry and in stock-breeding, it is the hands of the personnel or workers that are the main carrier of pathogens. Rigorous hand hygiene is therefore one of the most important measures for preventing infections and diseases in hospitals, nursing homes, medical practices, veterinary practices or dental practices, and in the food industry or pharmaceutical industry, and also in stock-breeding operations.

Effective hand hygiene consists of hand washing, or reducing the number of germs on the surface of the skin by mechanical means, and of disinfecting, which specifically kills or damages certain microorganisms. Depending on the situation, it may be sufficient to perform what is purely hygienic hand disinfection, in which the transient (temporarily present on the skin) flora of the hands (especially pathogenic germs) are eliminated. In order to achieve an almost complete sterility, it is possible, in surgical hand disinfection, to reduce not only the transient flora but also the resident (normal) flora of the hands.

In order to achieve the desired effect of hand hygiene, the procedures to be performed when washing the hands or disinfecting the hands are defined in various nationally and/or internationally recognized and harmonized regulations or legal provisions (e.g. standards). Besides certain requirements concerning the material composition of the cleaning or disinfecting liquid, it is also necessary for defined procedures to be performed for rubbing the hands, which procedures demand a precise chronological sequence of different rubbing movements. To guarantee rigorous compliance with these standards, the rubbing procedures that are to be performed are shown and described, for example, on posters placed alongside the dispensers for the cleaning or disinfecting liquids. Dispensers are also known in which the relevant information and instructions concerning the rubbing procedures are conveyed to the user on an integrated display device or by an in-built loudspeaker.

U.S. Pat. No. 6,375,038 B1 (Daansen et al.) describes, for example, a dispenser which automatically detects a user by means of a non-contact sensor and in which, after the liquid has been dispensed, instructions are output to the user in a time-controlled manner via three light-emitting diodes in accordance with a sequence of instructions programmed in a microprocessor.

The subject matter of EP 0 914 055 B1 (Ecolab Inc.) is a dispenser which automatically detects the user and then conveys sound-based and/or visual information, particularly concerning the correct use of the dispensed liquid.

Although known dispensers of this kind make it easier to comply with hygiene standards, they are not completely satisfactory. Thus, most of the dispensers according to the known prior art are only designed for a single type of cleaning or disinfecting agent. If another cleaning or disinfecting agent is used, which normally also requires another sequence of instructions, the dispenser has to be reprogrammed accordingly, if this is in fact possible. However, reprogramming is susceptible to error, and there is therefore always the danger that a dispenser does not output the sequence of instructions associated with the dispensed liquid. Alternatively, separate dispensers can be procured for each cleaning or disinfecting agent. This solution, however, is expensive and also susceptible to error. If the wrong cleaning or disinfecting agent is introduced into a dispenser, it may escape notice that the dispenser is not outputting the correct sequence of instructions.

DISCLOSURE OF THE INVENTION

The object of the invention is therefore to make available a dispenser which belongs to the technical field mentioned at the outset, ensures compliance with hygiene regulations and can also be used flexibly.

The object is achieved by the features defined in claim 1. According to the invention, the control unit is configured such that, during and after the dispensing of the liquid by the delivery device on the basis of a signal of the sensor for reading the identification of the replaceable liquid container, a sequence of instructions associated with the liquid container is retrieved from the first data memory and is output via the output device.

A dispenser of this kind has the considerable advantage that it can be used for various liquid containers which, for example, contain different liquids, without the dispenser having to be manually reprogrammed when changing between the various liquid containers. In this way, incorrect manipulations, e.g. wrong association of a sequence of instructions to the inserted liquid container, are greatly reduced. To guarantee a very high degree of safety, the identification of the inserted liquid container is also preferably read out each time the liquid is dispensed, and the associated sequence of instructions is retrieved and output via the output device. Should the liquid container have an identification that is unknown to the dispenser, the control unit of the dispenser can deliver a warning message via the output device and/or, if there is a suitable connection between delivery device and control unit, can prevent the dispensing of liquid from the unknown liquid container.

The liquid containers that are provided for use in the dispenser according to the invention can, for example, contain liquid or gel-like cleaning agents (e.g. soaps or specially disinfectant soaps) or disinfecting solutions. The exact directions for the use of the liquid soap or of the disinfecting solution can be predefined via the identification of the liquid container. Here, it is also possible for two liquid containers which contain the same liquid, e.g. a disinfecting solution, to be identified differently for different areas of use. For example, disinfecting of the hands in a hospital operating theater and in a patient's room is to be performed using the same disinfecting solution, but according to different nationally and/or internationally recognized and harmonized regulations or legal provisions (e.g. standards). These procedures differ, for example, in terms of the exact chronological sequence and intensity of the different rubbing movements of the hands. A disinfecting agent is, for example, approved for sale only when precisely defined requirements have been satisfied in special tests of their virucidal, bactericidal and/or fungicidal efficacy. The tests have to be carried out by an independent laboratory which assesses the duration of action needed to achieve the respective effect. It is imperative that this duration of action be satisfied during the period of use of the disinfecting agent. The dispenser according to the invention guarantees, among other things, that the prescribed durations of action are also observed.

The at least one non-contact proximity sensor, which serves to detect a hand of the user, also has the advantage that the user does not have to touch the dispenser in order to clean and/or disinfect the hands. This further simplifies the compliance with hygiene standards.

The dispenser according to the invention in particular guarantees simple and safe replacement of liquid containers, which is of great important especially in the hospital sector, since all the hand cleaning and/or disinfecting processes are defined in nationally and/or internationally recognized and harmonized regulations or legal provisions (e.g. standards), and compliance with these is of decisive importance for the wellbeing of personnel and patients. Here, wrongly associated washing and/or cleaning instructions can have very serious consequences. In addition, the dispenser according to the invention affords great flexibility, since it can be designed for different types of liquid containers. It is therefore no longer necessary to procure a large number of different dispensers that are designed only for a single liquid container.

The sensor is preferably configured for detecting a punched-hole code, such that a punched tape applied for identification of the liquid container can be read. Punched-hole codes are particularly simple and inexpensive to produce, since holes have to be punched only at predefined locations of the punched tape. With a 4-bit punched-hole code (or 4 hole areas arranged next to one another), it is possible, for example, to obtain 15 different identifications for the liquid containers. The holes of the punched-hole code can be of any desired shape. Rectangular, square, triangular or polygonal holes may also be suitable in particular. If, for example, the liquid container is present as a flexible bag, the punched tape can, for example, be directly integrated in a seam or an edge area of the bag. It is also possible, for example, to provide notches as holes in the edge area, such that a comb-like edge area serves as punched tape, for example. The notches can have a rectangular, square, triangular or polygonal shape and can also have rounded corners.

However, it is also possible to apply the punched tape or the punched-hole code to secondary packaging means. Secondary packaging means are, for example, wrappers made of cardboard or plastic that surround the flexible bag for purposes of protection. The holes can in this case be punched directly in edge areas of the wrapper, for example, or separate punched tapes can also be secured on the wrapper.

In particular, the sensor comprises a plurality of light barriers arranged next to one another, wherein the light barriers are configured to receive the punched tape of the liquid container. In this case, the receiving device for the liquid container is preferably designed in such a way that the punched tape comes to lie automatically between the light barriers upon insertion of the liquid container. The light barriers then permit optical reading of the punched-hole code of the punched tape. Optical reading has in particular the advantage that the punched-hole code can be read in an entirely contactless manner. It is thus possible to omit mechanical parts, which show signs of wear over the course of time.

However, it is also possible in principle for the punched-hole code of the punched tape to be read by a purely mechanical sensor. Thus, for example, it is possible to use a sensor comprising a plurality of pins which engage as mechanical probes in the open holes of the punched tape and are held back in closed areas of the punched tape. It is also possible to use sensors in the form of electrical punched-tape readers, in which case the pins engaging in the holes of the punched tape additionally produce an electrical contact.

In principle, however, other sensors are also conceivable which, for example, are configured for identifying radio waves (RFID) of a radio wave transmitter (RFID chip) arranged on the liquid container. Optical sensors can likewise be used to read a barcode arranged on the liquid container. The various coding possibilities can also be combined with one another.

In particular, the sensor can be configured for detecting a color code, such that a color pattern arranged as identification on the liquid container can be read. The sensor can, for example, be configured as a wavelength-sensitive optical sensor, such that, for example, a color pattern in the form of one or more color areas with preferably different colors on the liquid container can be detected and differentiated. In the present context, colors are to be understood as meaning all colors visible to the human eye, including black and white. However, the colors can also comprise substances emitting infrared light and/or ultraviolet light. It is also possible, for example, to use a sensor which can detect a color pattern in the form of a pattern of bright and dark areas, e.g. white and black areas. This can, for example, be a barcode sensor. The barcode sensor can be configured for detecting a one-dimensional barcode and/or a two-dimensional barcode, or one-dimensional barcodes distributed in several lines.

The sensor also in particular has a light source, such that the color patterns to be detected are irradiated with light of defined wavelength. This greatly facilitates an unambiguous association of the code arranged on the liquid-containing bag. In particular, substances emitting infrared light and/or ultraviolet light can also be excited by a suitable light source.

In another advantageous embodiment, the sensor is configured for detecting magnetic fields, such that one or more magnets arranged as identification on the liquid container can be detected. The sensor can in this case be configured, for example, in the form of one or more reed relays. Several reed relays can, for example, be arranged in a row and/or as a two-dimensional matrix. The magnets on the liquid-containing bags are then also correspondingly arranged in a row and/or as a two-dimensional matrix. A coding of the liquid-containing bag is then obtained by applying or omitting a magnet at the predetermined areas of the row or of the two-dimensional matrix.

The sensor is more preferably configured for detecting radio waves or electromagnetic radiation, such that a radio wave transmitter or electromagnetic transmitter arranged as identification on the liquid container can be read. The sensor in this case generates, for example, an electromagnetic high-frequency field, which supplies energy to the electromagnetic transmitter on the liquid-containing bag and initiates transmission of data from the electromagnetic transmitter to the sensor. It is possible in particular in this case to use RFID technology, which is known per se and which permits identification of the liquid-containing bag with the aid of electromagnetic waves.

The sensor is configured in particular for detecting an intensity of the electromagnetic radiation. In this way, for example, it is possible to determine the distance of the signal of the electromagnetic transmitter, or the distance of the liquid-containing bag, from the sensor. This in turn permits verification of the correct arrangement of the liquid container in the dispenser.

The sensors described above can also be combined with one another, which optimally ensures compliance with hygiene provisions.

Advantageously, the receiving device for the replaceable liquid container has at least two securing devices, in particular circular retention pins, which are arranged asymmetrically and/or are of different diameters. They are provided for form-fit engagement in receiving openings of a securing device on the replaceable liquid container and ensure an unambiguous arrangement of the replaceable liquid container in the dispenser. Circular retention pins with different diameters are a particularly simple way of securing the liquid container in a defined manner. The securing device of the liquid container in this case has circular receiving holes or receiving bores of correspondingly different diameters. The external diameters of the retention pins in the receiving device of the dispenser are approximately identical to the diameters of the circular receiving holes or receiving bores in the liquid container. Particularly in the case where the identifications of the liquid containers are in the form of punched tapes, this avoids the punched tape being read from the wrong side. The danger of a wrong association of a sequence of instructions to a liquid container is thus avoided. However, it is also possible, for example, to provide retention pins and receiving openings of different shapes. For example, a retention pin of round cross section and a retention pin of rectangular cross section can be arranged on the dispenser. Accordingly, the receiving holes of the liquid container likewise have a round shape and a rectangular shape, which also ensures an unambiguous arrangement of the liquid container in the dispenser.

If the securing devices of the liquid container are in the form of receiving holes, it is additionally advantageous to arrange these in the same area of the liquid container as the punched tape. In this case, the required holes for the punched tape and the receiving holes can be formed in a single operation, e.g. by a suitable punching machine. In the first place, this greatly simplifies the production process. Secondly, it ensures that the distance between receiving holes and punched tape, or the relative arrangement of all the holes to one another, is constant, even if the absolute position to the liquid container slightly varies. This ensures, among other things, that the punched tape is always aligned optimally with respect to the sensor when the liquid container is received.

In the case of asymmetrical securing devices, it is also possible to use liquid containers of any desired outer shape, e.g. bags. Liquid containers in the form of bags are particularly economical to produce, since no complicated geometrical outer shapes have to be created and since the amount of material needed can be kept low.

However, it is also possible to provide symmetrically designed securing devices. In this case, an unambiguous arrangement of the liquid container in the dispenser can be achieved, for example, by an asymmetrical outer shape of the liquid container, which makes it possible to close a cover or door of the dispenser when the liquid container is incorrectly inserted. The sensor for reading the identification of the liquid container can also be arranged on the side such that, when the liquid container is inserted the wrong way round, the identification is not directed at the sensor and cannot be read by the sensor.

The output device is preferably a liquid-crystal display which in particular has at least 1,024 separately controllable pixels. It is thus possible to output sequences of instructions in the form of texts and images and/or symbols. Instructions in the form of texts and images are intuitive and particularly easy for the user to understand, such that the danger of instructions being misunderstood is greatly reduced. In addition, with images in particular, complicated directions can be made easily intelligible to the user, such that, for example, the user in a sometimes very hectic and time-critical hospital environment can be instructed in the quickest possible time. Moreover, for example, patients or other users in an operating theater or in a consultation room are not disturbed by acoustic signals. This avoids spoken instructions output by a loudspeaker, which is felt in any case to be obtrusive. The at least 1,024 separately controllable pixels additionally ensure that sufficiently detailed images and/or symbols can be presented.

However, it is also possible in principle to provide other visual output devices for optical visualization. For example, displays consisting of a multiplicity of organic light-emitting diodes (OLED) can also be used. It is also within the scope of the invention to arrange a tube-based screen as output device. Moreover, output devices with fewer than 1,024 pixels can also be used, although less detailed and therefore less informative images and/or symbols are then able to be displayed.

Another particularly suitable output device is one in the form of a plurality of chronologically and separately controllable light-emitting diodes, which are arranged next to different pictograms. This represents a particularly inexpensive output device. The light-emitting diodes can in this case also be present as organic light-emitting diodes (OLED).

In addition to the visual output devices, however, it is also possible to arrange a sound-based output device, for example a loudspeaker, on the dispenser. In this way, instructions in the form of spoken text can be output.

The dispenser preferably has at least one control button, which is connected to the control unit of the dispenser. With the control buttons, the dispenser can be switched on and off, for example, or the current system time and date can be adjusted. It is likewise possible for presentation options, or the output format of the instructions on the display device, to be adapted to user-specific preferences. Thus, for example, the language of the sequences of instructions can be changed, or the brightness and the contrast of the output device can be adjusted. Advantageously, the user can also deposit parameter sets in a data memory of the control unit and retrieve these again at a later time. However, the control buttons are connected to the control unit in such a way that a modification of the sequences of instructions is not possible. This is achieved, for example, by a second and separate data memory being provided in the control unit for the sequences of instructions, which second data memory cannot be influenced by the at least one control button. In this variant, the control unit thus comprises at least two independent data memories.

In order to maintain the user-specific preferences for example in the event of a power outage, in the event of the dispenser being moved to a different location and/or in the event of the battery being changed, the control unit of the dispenser can be connected to a separate battery, an accumulator or a capacitor, which provides the required power. However, it is also possible that the data memory for the user-specific preferences is provided in the form of a flash memory, which permits persistent (nonvolatile) storage of the information without permanent current and/or voltage supply.

Advantageously, an electromechanically driven ram and a contact face lying opposite the latter are arranged as parts of the delivery device in the dispenser. If a flexible outlet tube communicating with the liquid container is arranged between these two elements of the delivery device, the flexible outlet tube can be elastically deformed by the ram and pressed against the opposite contact face. Liquid that passes from the liquid container into the outlet tube is in this case pressed in a defined amount out of the outlet opening of the outlet tube and dispensed into the hands of the user. A nonreturn valve or flap valve is preferably fitted between outlet tube and liquid container, such that the liquid is prevented from flowing back into the liquid container from the outlet tube when the latter is compressed. A valve can also be arranged in the area of the outlet opening of the outlet tube, which valve prevents the liquid from flowing out of the outlet tube in an uncontrolled and undesired manner. However, it is also possible to provide a sufficiently small outlet opening, such that uncontrolled flow of the liquid out of the outlet opening is prevented purely by adhesive and/or cohesive forces in the liquid.

The ram itself can be driven, for example, by an electric motor and by a downstream reduction gear with cam. However, it is also possible in principle to use a pneumatic drive for the ram.

The outlet tube can be arranged, for example, directly on the liquid container and, when the liquid container is replaced, can be replaced along with the latter. This has the advantage that the flexible outlet tube can be made from a relatively inexpensive material, since the longest it has to be able to be used is until the liquid container has been completely emptied. However, it is also possible to use one outlet tube on several liquid containers, if said outlet tube is sufficiently durable. In another variant, it is also possible to provide an outlet tube that is arranged fixed in the dispenser. However, the repeated use of an outlet tube or a fixed outlet tube in some cases has the disadvantage that, when changing to a liquid container with another liquid, the outlet tube has to be cleaned.

In principle, however, it is also possible, for example, for the delivery device to be provided in the form of a rotary vane pump or rotary piston pump communicating with the outlet tube. However, the electromechanically driven ram and the contact face lying opposite the latter along with the flexible outlet tube represent a delivery device that is particularly simple and inexpensive to produce and which in addition greatly simplifies hygienically correct handling of the dispenser and optimally prevents uncontrolled and undesired vaporization of readily volatile liquid components from the liquid container. In this way, it is also ensured that the composition of the liquid in the liquid container does not change during use.

Preferably, the contact face can be displaced by a mechanical adjustment device in a direction of movement of the electromechanical ram. In this case, the mechanical adjustment device preferably comprises an adjustment screw that can be actuated by hand. The distance between contact face and ram can be changed in this way, as a result of which the flexible outlet tube arranged between them can be compressed or elastically deformed to varying degrees. The more the elastic outlet tube is deformed, the greater the amount of liquid that is dispensed. If, with a constant maximum excursion of the electromechanical ram, the contact face is brought closer to the electromechanical ram, the amount of liquid dispensed is accordingly increased. Correspondingly, the amount of liquid dispensed is reduced when the contact face is drawn away from the ram.

If the mechanical adjustment device has an adjustment screw, the amount of liquid dispensed can be easily adjusted. A specific number of rotations of the adjustment screw can be associated, for example, with a defined forward or rearward movement of the contact face, as a result of which a reproducible adjustment of the amount of liquid dispensed is made easier. A rotation movement can also be effected without difficulty using just one hand, which further simplifies the handling of the dispenser.

Since it is important in most cleaning processes that the user's hands are completely wetted and also remain so during the cleaning processes, users with larger hands can increase the amount of liquid dispensed.

Conversely, users with smaller hands can reduce the amount of liquid dispensed, so as not to use up liquid unnecessarily. Generally, about 1-6 ml of liquid are dispensed upon each dispensing procedure. It is also possible to adapt the dispensed amount to the respective product. It has been found that with soaps an amount of 1-2 ml is sufficient for almost all users. In the case of disinfecting agents, the optimal amount is slightly greater at ca. 3-6 ml.

In principle, however, another adjustment device can also be provided. Thus, it is also possible to arrange the contact face movably on a guide rail and move it to and fro by hand. The contact face can then be fixed at the respectively desired position using a clamping device, for example a clip. It is likewise possible to completely do without an adjustment mechanism for the contact face. In this case, the delivery device can be designed, for example, such that only a relatively small amount of liquid is dispensed per dispensing procedure, which amount is not sufficient to completely wet both hands of a user. For this purpose, the user is able to trigger dispensing of liquid several times, until a sufficient total amount is present on his hands.

In particular, proximity sensors are arranged on at least two opposite sides of the outlet opening of the outlet tube, such that the liquid from the liquid container communicating with the outlet tube is dispensed directly into the hand of the user independently of a direction of approach of the user. Arranging the sensors to the sides of the outlet opening ensures that the user's hands are present in the area under the outlet opening when the liquid is dispensed. Since, in a preferred embodiment, the dispensing of liquid is simply initiated when one of the two proximity sensors detects a hand, the provision of two proximity sensors increases the probability of the dispensing of the liquid taking place at the user's first attempt. In most conventional dispensers, only one proximity sensor is provided, such that the user sometime has to instigate several attempts to trigger the dispensing of the liquid. In a hospital environment in particular, where emergency situations continually arise and rapid action is required, two proximity sensors thus represent a considerable advantage.

It is also possible in principle to use just one sensor, but in this case the user in some circumstances has to move his hands back and forth several times in the area of the outlet opening until they are detected by the sensor and the dispensing of the liquid is triggered by the control unit of the dispenser. It is likewise possible, for example, to place the sensor in another area of the dispenser, e.g. next to the output device for the instructions. However, after the user's hands have been detected by the sensor, the user then has to move his hands into the area of the outlet opening. If this movement is too slow, the dispensed liquid is lost.

Advantageously, the sequences of instructions comprise individual instructions with time details concerning the performance of certain cleaning actions, in particular instructions concerning the cleaning and/or disinfecting of hands. In this way, individual instructions and information concerning the cleaning process or disinfecting process to be performed can be output to the user in real time. For example, individual cleaning actions, such as procedures for rubbing the hands, can be presented in an animated graphic, while at the same time a progress indicator, e.g. an animated clock or a progress bar, provides information on the chronological progress of the rubbing procedure being performed. Thereafter, the subsequent cleaning actions of the cleaning process can be presented step by step in further animated graphics, until finally the entire cleaning process has been completed. Thereafter, the dispenser can output further information asking the user, for example, to use a further dispenser. Thus, for example, a dispenser provided with soap can prompt the user, at the end of the cleaning process with soap, to then use a dispenser containing a disinfecting solution.

This greatly simplifies the performance of multi-step cleaning processes which, particularly in the hospital environment, have to be carried out many times in order to comply with the regulations and provisions. In particular, the user can be guided step by step through the cleaning or disinfecting process in real time, which process can additionally be displayed in the form of intuitive images and/or animated graphics.

It is also possible in principle, during the ongoing instruction of a first user, to divide the output device into a left half and a right half, for example when the hand of a second user is detected. In this way, the already ongoing sequence of instructions can be continued, e.g. on the right half of the output device, while a newly started sequence of instructions is output on the left half of the output device. The dispenser can thus be used by two users simultaneously. Therefore, the second user does not have to wait until the first user has completed the entire sequence of instructions, and instead he can in principle use the dispenser shortly after the liquid has been dispensed to the first user.

Further advantageous embodiments and combinations of features of the invention will become clear from the following detailed description and from the entirety of the claims.

BRIEF DESCRIPTION OF THE DRAWINGS

In the drawings used to explain the illustrative embodiment.

In principle, identical parts are provided with the same reference signs in the figures.

WAYS OF IMPLEMENTING THE INVENTION

Figure 1:
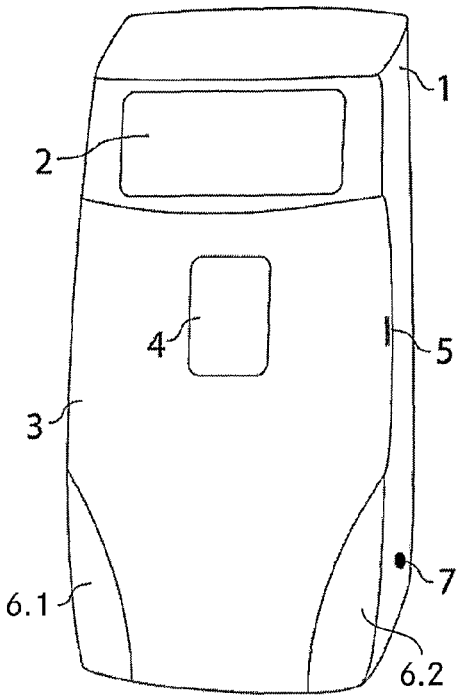
FIG. 1 shows a perspective view of a dispenser.

In FIG. 1, a dispenser according to the invention, with a substantially cuboid housing 1, is shown in a perspective view obliquely from the front. In the area of the front upper edge, the housing 1 has a rearwardly chamfered surface in which a rectangular liquid-crystal display 2 is formed. Underneath the liquid-crystal display 2, a door 3 mounted on the housing 1 of the dispenser extends across the entire lower area of the front face of the dispenser. The door 3 in this case has an outwardly curved shape. In order to open the door 3, a grip 5 is additionally arranged on the door 3, in the upper area on the right-hand side. The two front edges of the housing 1 are chamfered in the lower half by a left-hand bevel 6.1 increasing in a vertical direction of the dispenser and by a right-hand bevel 6.2 formed symmetrically thereto. In the lower left-hand corner and lower right-hand corner, the door 3 has two recesses which are shaped according to the two bevels 6.1, 6.2, such that there is a relatively smooth transition between the two bevels 6.1, 6.2 and the door 3. Located in the upper area of the door 3, approximately at the center in the horizontal direction of the dispenser, there is a rectangular window 4, which permits a view into the inner areas of the dispenser when the door 3 is closed. Moreover, on the right-hand side face of the housing 1, there is a connector socket 7 for an external power supply.

Figure 2:
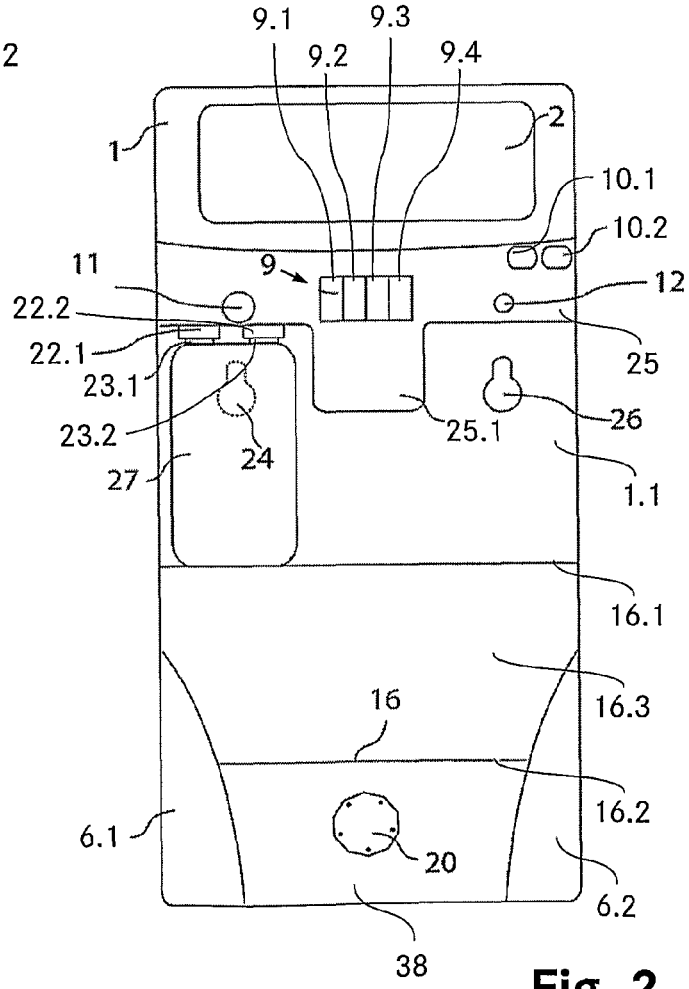
FIG. 2 shows a front view, with the door removed, into the interior of the dispenser from FIG. 1.

In FIG. 2, the dispenser from FIG. 1 is shown with the door 3 removed. The whole interior of the dispenser, closed off by the door 3 in FIG. 1, is therefore visible. Underneath the liquid-crystal display 2, a sensor 9 is located approximately at the center on a first inner and vertical securing surface 25 between the two side edges of the dispenser, which sensor 9 is composed of four light barriers 9.1, 9.2, 9.3, 9.4 arranged next to one another. Underneath the sensor 9, the first securing surface 25 has a rectangular continuation 25.1, which is provided in particular as a bearing plate for a liquid container that is to be received. On the right-hand side of the first securing surface 25, laterally above the sensor 9, two control buttons 10.1, 10.2 for the liquid-crystal display are arranged horizontally alongside each other. To the left of the sensor 9, a first round retention pin 11 protrudes perpendicularly forward from the first securing surface 25. On the right-hand side of the sensor 9, a second round retention pin 12 protrudes perpendicularly forward from the first securing surface 25. On the front face visible in FIG. 2, the second retention pin 12 in this case has a diameter that is approximately half as large as the first retention pin 11. Underneath the first retention pin 11, and to the left of the rectangular continuation 25.1, two electrical contacts 22.1, 22.2 of the dispenser protrude vertically downward. They are connected to two battery contacts 23.1, 23.2 of a square battery 27, which protrudes downward on the left-hand side of the rectangular continuation 25.1. To the left of and next to the rectangular continuation 25.1, a first securing bore 24, concealed by the battery 27, is formed in the rear wall 1.1 of the housing 1. To the right of and next to the rectangular continuation 25.1, a second securing bore 26 is likewise formed in the rear wall 1.1 of the housing 1. The two securing bores 24, 26 are shaped identically and are provided for securing the dispenser, for example with screws, to a wall or another third element.

The battery 27, which serves to supply the dispenser with power, bears on a first shoulder 16.1 which protrudes forward (from the image plane) horizontally, or perpendicular to the rear wall 1.1 of the housing 1. On the front edge of the first shoulder 16.1, there is a downwardly and forwardly directed oblique surface 16.3 which, with its lower area, protrudes between the upper area of the two bevels 6.1, 6.2 of the housing 1. On the lower edge of the oblique surface 16.3 there is a second shoulder 16.2, which is likewise formed perpendicular to the rear wall 1.1 of the container 1 and is therefore coplanar with respect to the first shoulder 16.1. However, the second shoulder 16.2 is situated in front of the first shoulder 16.1 in a direction perpendicular to the rear wall 1.1 of the dispenser. The two shoulders 16.1, 16.2 and the oblique surface 16.3 therefore have a chair shape. (The arrangement is shown in profile in FIG. 5).

Underneath the second shoulder 16.2, and starting at the front edge thereof, a second vertical securing surface 38 is arranged between the two bevels 6.1, 6.2 of the housing. The second securing surface 38 is arranged approximately in the same plane as the first securing surface 25 (see also FIG. 5). Approximately in the middle area of the securing surface 38, a ten-cornered adjustment screw 20 extends perpendicularly forward from the securing surface 38. Every second corner of the uniformly shaped ten corners of the adjustment screw 20 is in this case provided with a point-shaped marking.

Figure 3:
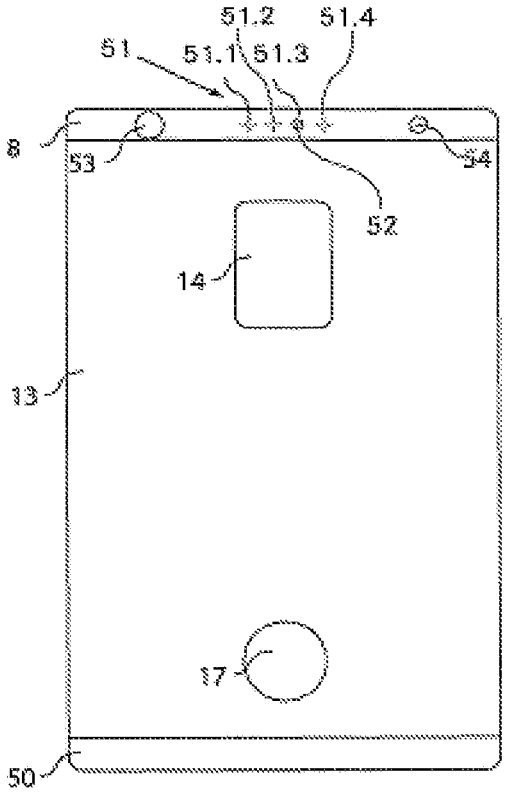
FIG. 3 shows a view of a bag with a punched-hole code and two suspension openings in the seam, which bag is provided for use in the dispenser from FIG. 1.
Figure 4:
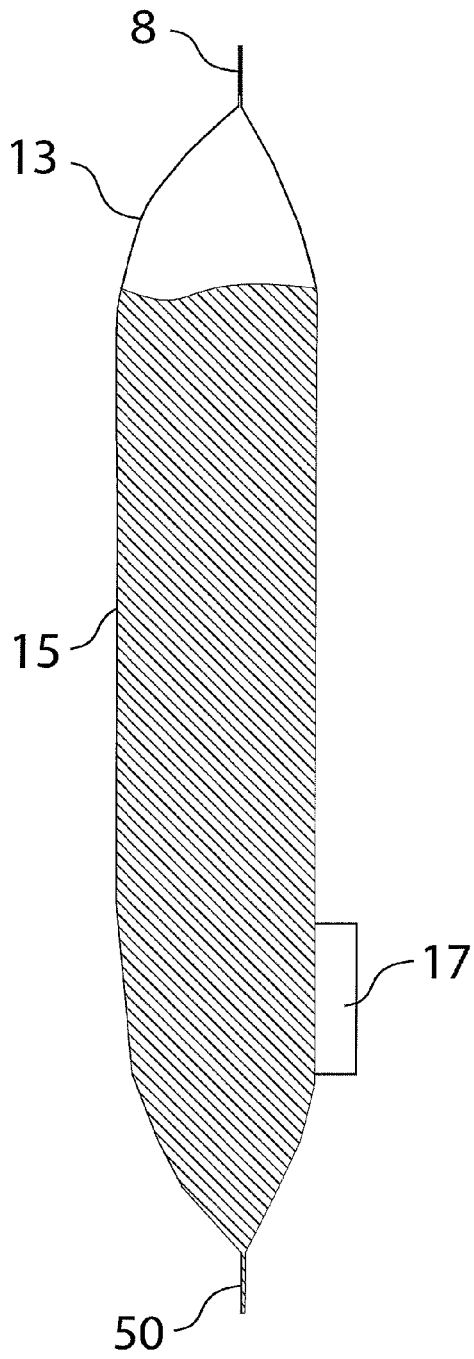
FIG. 4 shows a side view of the bag from FIG. 3.

FIGS. 3 and 4 show a flexible bag 13 as liquid container, which bag is filled, for example, with a disinfecting solution 15 (e.g. a mixture of povidone-iodine, chlorhexidine, ethanol, isopropanol and/or n-propanol). The bag 13 is in this case designed to be disposed of after use and is made, for example, from a tubular plastic film that has an elliptic cross section. The upper end of the tubular plastic film is in this case welded to form an upper rectangular edge area 8, and the lower end is welded to form a lower rectangular edge area 50. A first circular securing hole 53 is formed on the left-hand side in the upper rectangular edge area 8. This securing hole 53 corresponds in diameter approximately to the diameter of the first retention pin 11 as seen in FIG. 2. On the right-hand side, a second circular securing hole 54 is correspondingly formed in the upper rectangular edge area 8. The diameter of the second securing hole 54 is approximately half as great as the diameter of the first securing hole 53 and therefore corresponds approximately to the diameter of the second retention pin 12 from FIG. 2. The two securing holes 53, 54 in the upper edge area 8 are therefore provided for securing the bag 13 on the two retention pins 11, 12, and the different diameters of the securing holes 53, 54 and of the retention pins 11, 12 ensure a defined arrangement of the bag 13 in the dispenser.

The area in the middle between the two securing holes 53, 54 is designed as a punched tape 51, which has a total of four columns 51.1, 51.2, 51.3, 51.4 which are arranged next to one another in the horizontal direction and are designated by cross-shaped markings.

For identification of the bag 13, the areas of the four columns 51.1, 51.2, 51.3, 51.4 can either be closed, or almost impenetrable to light, or can have a perforation allowing light to pass through. By the different possible combinations of penetrable and closed columns, fifteen different identifications of the bag 13 are possible with the four columns 51.1, 51.2, 51.3, 51.4. Specifically, a first column 51.1 of the punched tape, as seen from the left, is closed in FIG. 3. The second column 51.2 of the punched tape 51, as seen from the left, is likewise closed. By contrast, the third column 51.3, as seen from the left, has a perforation 52 in the form of a punched-out and circular hole. The last column 51.4, as seen from the left, is again closed like the first column 51.1.

Underneath the upper edge area 8, a label 14, with information concerning the bag 13 and concerning the disinfecting solution 15 located in said bag 13, is affixed to the front face, approximately at the center, in the upper half of the bag 13. When the bag is inserted in the dispenser, the label 14 is visible through the rectangular window 4 of the dispenser even when the door 3 is closed.

In the lower half of the bag 13, an annular connection element 17 is arranged flat on the surface above the lower edge area 50. The annular connection element 17 has, on the outside, a thread that allows an outlet tube to be screwed on.

Figure 5:
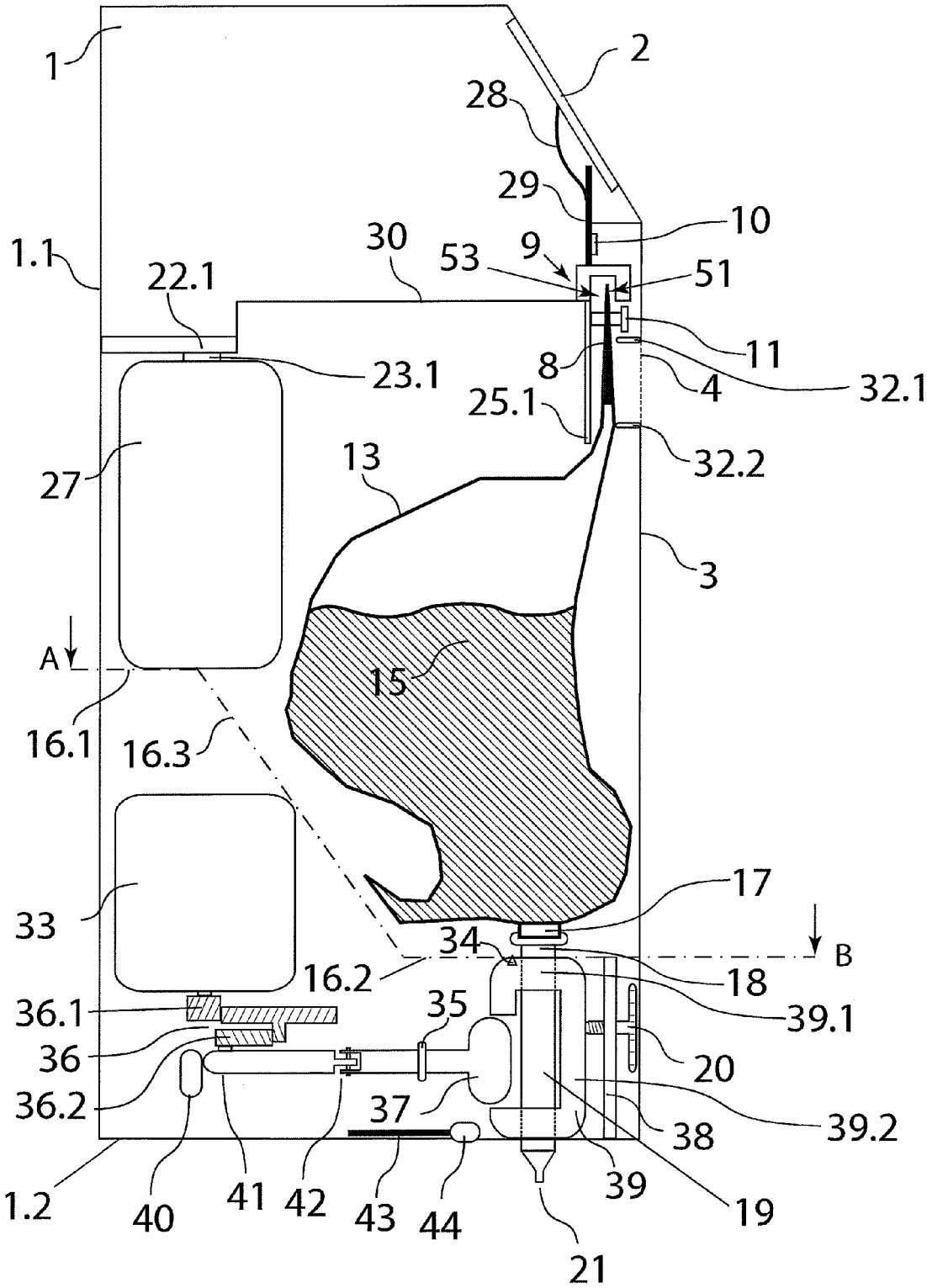
FIG. 5 shows a schematic side view into the interior of the dispenser from FIG. 1, with the bag from FIGS. 3 and 4 inserted therein.

In FIG. 5, the interior of the dispenser from FIGS. 1 and 2 is shown from the left, with the left side wall removed. The bag 13 from FIGS. 3 and 4 is in this case inserted in the dispenser. The first retention pin 11 is inserted in the first securing hole 53 of the bag 13, such that the latter is held hanging down from the upper edge area 8. A first projection 32.1 on the inner face of the door 3 presses the bag 13, above the window 4, onto the securing surface 25. Underneath the window 4, a second projection 32.2 is mounted on the inner face of the door 3 and presses the bag 13 against the rectangular continuation 25.1 of the securing surface 25. The area of the punched tape 51 of the bag 13 lies between the U-shaped sensor 9, such that the four columns 51.1, 51.2, 51.3, 51.4 of the punched tape 51 are each arranged in front of one of the four light barriers 9.1, 9.2, 9.3, 9.4, respectively. The four light barriers 9.1, 9.2, 9.3, 9.4 then easily permit determination of the state (open or closed) of the four columns 51.1, 51.2, 51.3, 51.4.

A control unit 29, composed of a microprocessor and of a data memory on a circuit board 29.1, is arranged directly above the sensor 9. The control unit 29 is connected to the sensor 9 via an electric cable 28. The control unit 29 is likewise connected by an electric cable (not shown in FIG. 5) to the motor control 43 (see also FIG. 6).

A flexible cylindrical outlet tube 19 is mounted on the connection element 17 of the bag 13, which connection element 17 forms the lowermost area of the inserted bag 13. The connection element 17 is situated just above the second shoulder 16.2. The outlet tube 19 is routed through the second shoulder 16.2 via an opening (not visible in FIG. 5) and protrudes vertically downward from the bottom 1.2 of the dispenser. The outlet tube 19 has, at the upper end thereof, an annular securing screw 18 with inner thread, which is screwed onto the thread on the outside of the connection element 17, such that the outlet tube 19 is secured on the bag 13. Since the bag 13, during application of the outlet tube 19 to the connection element 17, is pierced and/or cut open in the central area of the connection element 17 by a cutting edge that protrudes upward inside the outlet tube 19, the bag 13 and the outlet tube 19 communicate with each other. In the area of the free end of the outlet tube 19, the latter narrows conically and then merges into a thinner but still cylindrical outlet opening 21. In the area of the annular securing screw 18, a first non-return valve (not shown) mounted in the inside of the outlet tube 19 prevents the disinfecting solution 15 present in the outlet tube 19 from flowing back into the bag 13 during the dispensing of the liquid. In the area of the outlet opening 21, a second valve (not shown) is mounted in the inside of the outlet tube 19 and ensures that the disinfecting solution 15 present in the outlet tube 19 emerges only when pressure is applied to the outlet tube 19 (by the delivery device) and does not drip out or run out in an uncontrolled manner.

Underneath the second shoulder 16.2, there is a substantially U-shaped profile which lies with its lower branch 39.2 on the inner face of the bottom 1.2 and is joined by its upper branch 39.1 directly to the underside of the second shoulder 16.2. The outlet tube 19 is routed through the U-shaped profile 39 by way of bores (not visible in FIG. 5) in both branches 39.1, 39.2 of said U-shaped profile 39. The base 39.3 of the U-shaped profile 39 is situated on the right-hand side of the outlet tube 19 in a vertical orientation, and parallel thereto, between outlet tube 19 and vertical securing surface 38. By means of the adjustment screw 20, which is routed through the vertical securing surface 38 from the direction of the door 3, the U-shaped profile 39 can be moved in a direction away from the vertical securing surface 39 toward the rear wall 1.1 of the housing 1, or back.

Underneath the first shoulder 16.1 and the oblique surface 16.3, an electric motor 33 with a vertically downwardly directed pinion 36.1 is arranged on the rear wall 1.1 of the dispenser. The pinion 36.1 drives a multi-step reduction gear 36, wherein the last toothed wheel 36.2 in the reduction gear 36 drives a lever 41 via an eccentric cam of the last toothed wheel 36.2. At the end remote from the last toothed wheel 36.1, the lever 41 is coupled to a ram 37 by way of a hinge 42. The ram 37 is mounted in an annular guide device 35. The situation shown in FIG. 5 corresponds to the starting position in which the ram 37 is pulled back to the maximum extent in the direction of the rear wall 1.1. The lever 41 here actuates a motor switch 40 arranged behind it.

To the left alongside the outlet tube 19 protruding from the bottom 1.2 of the dispenser, a first proximity sensor 44, likewise protruding from the bottom 1.2 of the dispenser, is arranged between the rear wall 1.1 and the outlet tube 19.

When the motor 33 turns, the ram 37 is driven via the gear 36 and the lever 41 and is moved toward and away from the door 3 in a direction perpendicular to the rear wall 1.1. The ram is in this case arranged such that it is pushed into the opening of the U-shaped profile 39 opposite the base 39.3 and presses against the side of the outlet tube 19. As the outlet tube 19 is pressed against the inner face of the base 39.3 of the U-shaped profile 39, the outlet tube 19 is elastically deformed. A nonreturn valve (not shown) arranged in the area of the annular securing screw 18 in the inside of the outlet tube prevents the liquid present in the outlet tube from being forced back into the bag 13. The valve arranged in the inside of the outlet tube 19, in the area of the outlet opening 21, thus opens, as a result of which a defined amount of disinfecting solution is dispensed.

After a complete revolution of the last toothed wheel 36.2 of the gear 36, the lever 41 actuates the motor switch 40 as the ram 37 is pulled back, as a result of which the motor control 43 switches the electric motor 33 off and the gear 36 with the lever 41 and the ram remains in the retracted starting position. In this way, a precisely defined amount of disinfecting solution 15 is dispensed. Even if the user leaves his hands in the area of the proximity sensor, no further dispensing of liquid takes place. If a user requires additional disinfecting solution 15, he can withdraw his hands from one of the two proximity sensors 44, 46 and then move them back again toward it. In this case, disinfecting solution is dispensed again in the manner described above.

Figure 6:
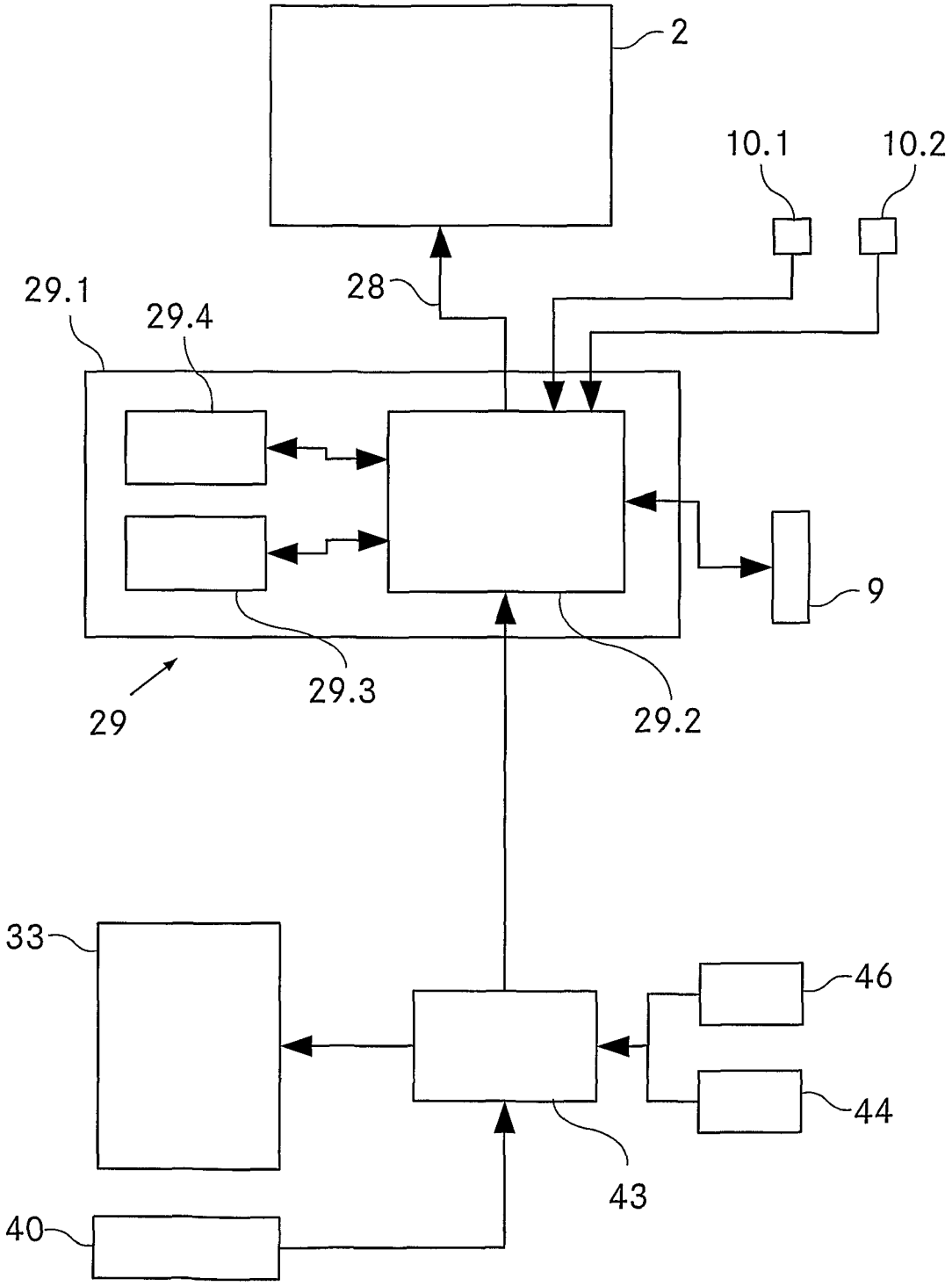
FIG. 6 shows a schematic block diagram with the control unit of the dispenser from FIG. 5.

FIG. 6 shows a block diagram of the dispenser. The central control unit 29 of the dispenser is composed of a microprocessor 29.2, a first data memory 29.3 and a second data memory 29.4 on a common circuit board 29.1. Several different sequences of instructions for the various bags 13 that can be used in the dispenser are stored as text information and image information in the first data memory 29.3. The control unit 29 is connected by an electric cable 28 to the liquid-crystal display 2. The control buttons 10.1, 10.2, which are likewise connected to the microprocessor 29.2 of the control unit 29, permit the adjustment of various user settings and formatting parameters, which influence the presentation of the sequences of instructions on the liquid-crystal display 2. These include, for example, the brightness or contrast of the liquid-crystal display 2, the language of the text information, or date and time formats. The two control buttons 10.1, 10.2 can also be used to set the current clock time and the date. The user settings and formatting parameters can be stored in the second data memory 29.4 and can be selected again by the user via the two control buttons 10.1, 10.2 and read from the microprocessor 29.2. The sequences of instructions that are to be output can thus be adapted to user-specific preferences in an easy-to-follow way.

The two proximity sensors 44, 46 are in this case connected directly to a motor control 43. As soon as one of the two proximity sensors 44, 46 detects the presence of a hand, the motor control 43 switches the electric motor 33 on. The latter turns until the motor switch 40 is actuated by the lever 41, as has been described in FIG. 5. The motor control 43 then switches the electric motor 33 off.

A short time after liquid has been dispensed, or after the electric motor 33 has been switched off, the motor control 43 sends a signal to the microprocessor 29.2 of the control unit 29 via an electric cable (not shown). The microprocessor 29.2 then determines the identification or the punched tape 51 of the bag 13 via the sensor 9 and retrieves, from the first data memory 29.3 of the control unit 29, a sequence of instructions corresponding to the identification. The sequences of instructions are formatted on the basis of the user settings and formatting parameters read from the second data memory 29.4, and they are then sent in a time-controlled manner to the liquid-crystal display 2 and are presented by the latter according to the user settings and the formatting parameters.

Figure 7:
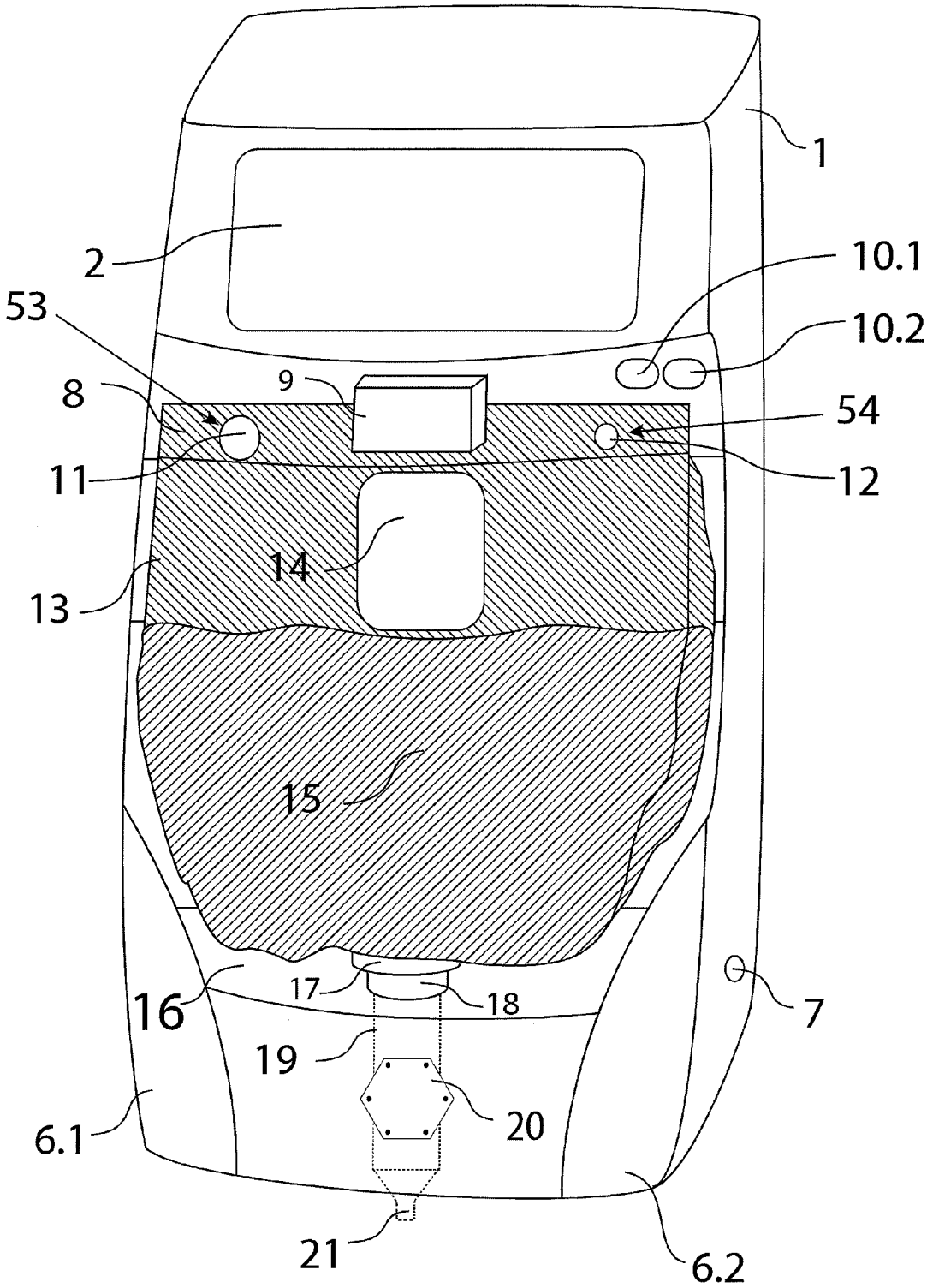
FIG. 7 shows a perspective view of the dispenser with the door removed and with the bag from FIG. 5 inserted.

A perspective view of the arrangement from FIG. 5, with the door 3 of the dispenser removed, is shown in FIG. 7. The second retention pin 12, which is pushed into the second securing opening 54 of the bag 13, can be seen in particular here.

Figure 8:
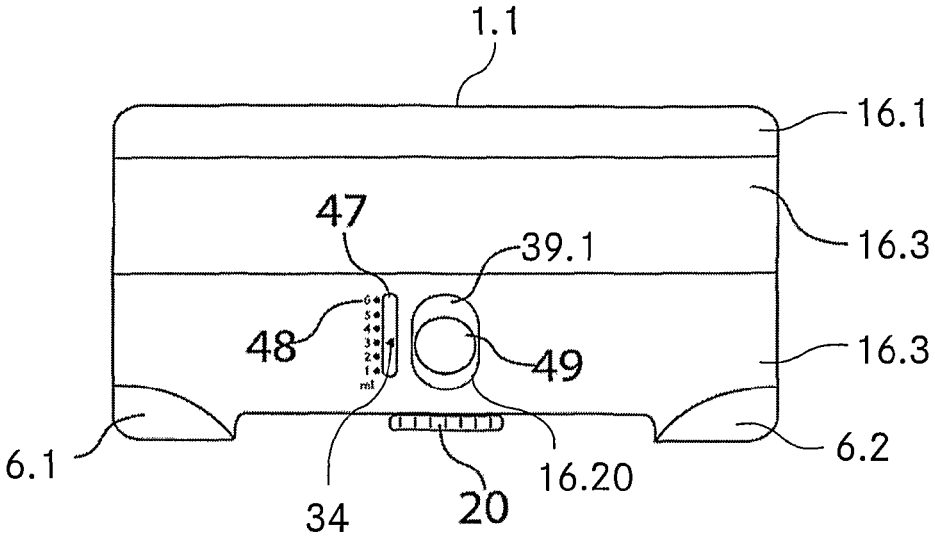
FIG. 8 shows a cross section along the line A-B in FIG. 4.

FIG. 8 shows a cross section through the dispenser along the line A-B in FIG. 5. A first slit-shaped opening 16.20 with rounded corners is formed here approximately at the center of the second shoulder 16.2, the longitudinal direction of the first slit-shaped opening 16.20 being in a direction perpendicular to the rear wall 1.1. The circular bore 49, formed in the upper branch 39.1 of the U-shaped profile and arranged underneath the second shoulder 16.2, can be seen within the first slit-shaped opening 16.20. The circular bore 39.1 has a diameter corresponding approximately to the width of the first slit-shaped opening 16.20 of the second shoulder 16.2. In this way, when the adjustment screw 20 is turned, the outlet tube 19, guided through and held by the circular bore 49, can be moved freely to and fro in the direction of the rear wall 1.1 through the upper branch 39.1 or through the U-shaped profile 39 by the length of the first slit-shaped opening 16.20.

A second slit-shaped opening 47 is also formed in the second shoulder 16.2, to the left of and parallel with the first slit-shaped opening 16.20. Arranged in said second slit-shaped opening 47, there is an arrow-shaped pointer 34 which is connected securely to the U-shaped profile 39. When the adjustment screw 20 is turned, the arrow-shaped pointer 34 moves back and forth in the second slit-shaped opening 47 with the U-shaped profile. A graduated scale 48 to the left of the second slit-shaped opening 47 ranges from 1 ml to 6 ml and thus indicates approximately the amount of liquid that is dispensed by a movement of the ram 37.

Figure 9:
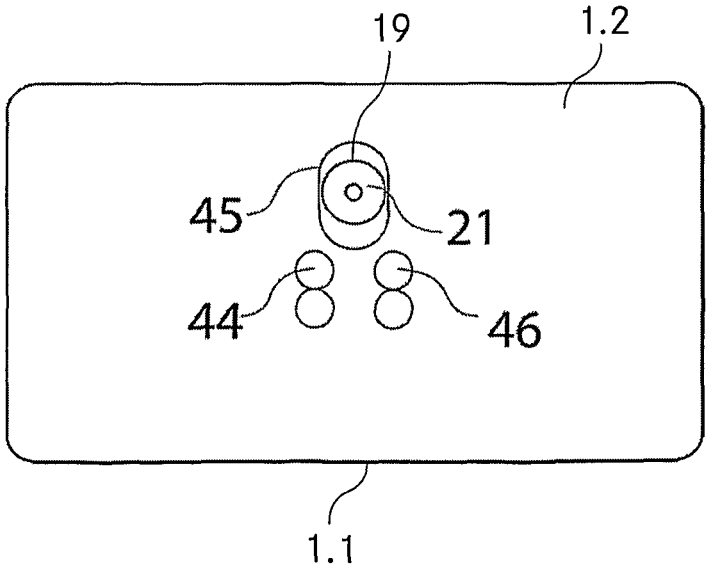
FIG. 9 shows a bottom view of the dispenser, with the bag from FIGS. 4 and 5 inserted.

FIG. 9 shows a bottom view of the dispenser from FIG. 5. The rear wall 1.1 of the dispenser is arranged at the bottom in FIG. 8. In the upper half of the rectangular bottom 1.2, the outlet opening 21 of the outlet tube 19 protrudes approximately centrally from a third slit-shaped opening 45 in the bottom 1.2 of the dispenser. The third slit-shaped opening 45 has substantially the same shape as the first slit-shaped opening 16.20 and likewise serves for the free displaceability of the outlet tube 19. The first proximity sensor 44 is arranged toward the left underneath the third slit-shaped opening 45, while the second proximity sensor is arranged toward the right underneath the third slit-shaped opening 45. When the dispenser is secured with the rear wall 1.1 to a third element, the two proximity sensors 44, 46 thus lie between the third element and the outlet opening 21 of the outlet tube 19. This ensures that the user, who approaches the dispenser from the front, that is to say from the face of the dispenser directed away from the rear wall 1.1, holds his hand under the outlet opening 21, while his hand is detected by one or both of the two proximity sensors 44, 46, and the disinfecting solution 15 is dispensed.

FIGS. 10*a-f* show a sequence of instructions or instruction procedures that help the user carry out hygienic disinfection of the hands for ca. 30 seconds in accordance with the European standard EN 1500. The individual hand disinfection measures that are to be taken are presented in steps and in a time-controlled manner on the liquid-crystal display 2 after the disinfecting solution 15 has been dispensed and after the punched tape 51 has been identified by the sensor 9.

This sequence of instructions is to be understood only as an example. If a bag with a different identification is inserted in the dispenser, a sequence of instructions associated with this bag is retrieved from the data memory of the control device 29 and presented on the liquid-crystal display 2.

Figure 10A:
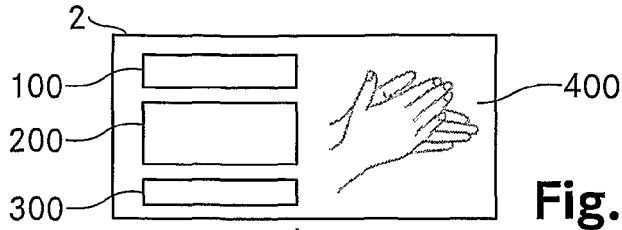
FIGS. 10*a-f* show an example of a sequence of instructions output on the liquid-crystal display of the dispenser from FIG. 1.

The information presented on the liquid-crystal display 2 in FIG. 10*a* includes a first device status 100 of the dispenser in the form of a symbol, which represents the charge status of the battery 27. Shown underneath this is a first text instruction 200, which prompts the user to rub the palms of his hands against each other. Moreover, a first progress display 300 in the form of a mixed presentation of text and symbols provides information on the hand-rubbing movements that are still to be performed. Alongside this, a first animated image 400 is presented showing the hand-rubbing movement that is to be performed.

Figure 10B:
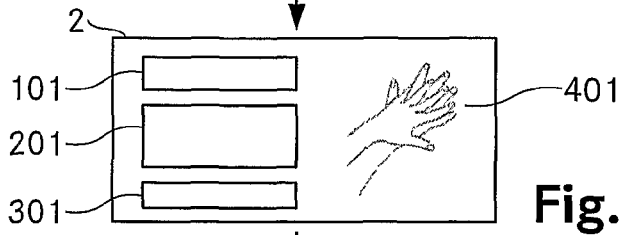

After about 8 seconds, the information shown in FIG. 10*b* is presented on the liquid-crystal display 2. The updated second device status 101 is displayed. The second text instruction 201 prompts the user to rub the palm of one hand against the back of the other hand, and vice versa. This is accompanied by the second animated progress display 301, in the form of a mixed presentation of text and symbols concerning the number of hand movements still to be performed, and by the second animated image display 401 of the movements that are to be performed.

Figure 10C:
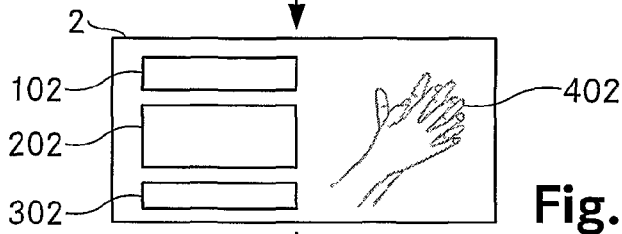

After about 11 seconds, the information shown in FIG. 10*c* is presented on the liquid-crystal display 2. The updated third device status 102 is displayed. The third text instruction 202 asks for the palms to be placed together with the fingers clasped. This is accompanied by the third animated progress display 302, in the form of a mixed presentation of text and symbols concerning the number of hand movements still to be performed, and by the third animated image display 402 of the movements that are to be performed.

Figure 10D:
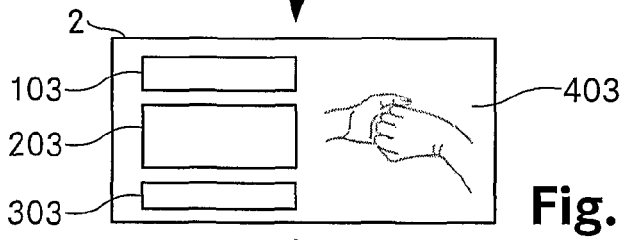

After about 19 seconds, the information shown in FIG. 10*d* is presented on the liquid-crystal display 2. The updated fourth device status 103 is displayed. The fourth text instruction 203 prompts the user to rub the dorsal aspect of the fingers of one hand against the palm of the other hand. This is accompanied by the fourth animated progress display 303, in the form of a mixed presentation of text and symbols concerning the number of hand movements still to be performed, and by the fourth animated image display 403 of the movements that are to be performed.

Figure 10E:
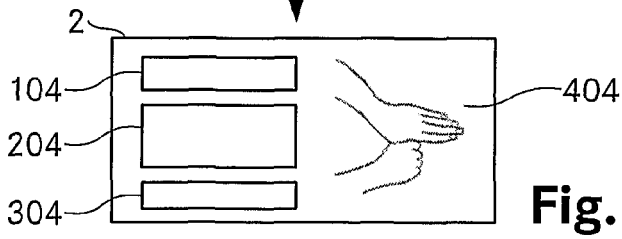

After about 22 seconds, the information shown in FIG. 10*e* is presented on the liquid-crystal display 2. The updated fifth device status 104 is displayed. The fifth text instruction 204 asks for alternate rubbing of the right and left thumbs. This is accompanied by the fifth animated progress display 304, in the form of a mixed presentation of text and symbols concerning the number of hand movements still to be performed, and by the fifth animated image display 404 of the movements that are to be performed.

Figure 10F:
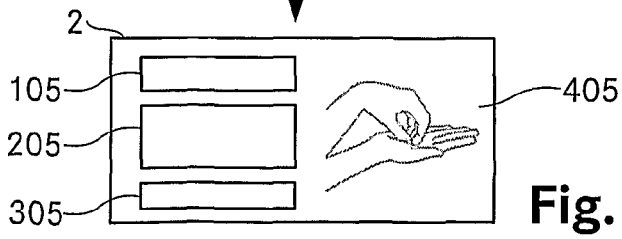

After about 29 seconds, the information shown in FIG. 10*f* is presented on the liquid-crystal display 2. The updated sixth device status 105 is displayed. The sixth text instruction 205 prompts the user to rub the closed fingers of one hand on the palm of the other hand. This is accompanied by the sixth animated progress display 305, in the form of a mixed presentation of text and symbols concerning the number of hand movements still to be performed, and by the sixth animated image display 405 of the movements that are to be performed.

The disinfecting of the hands is then complete, and a corresponding message is shown in the liquid-crystal display 2.

The embodiment described above is to be understood merely as an illustrative example that can be modified as desired within the scope of the invention.

Thus, the housing 1 of the dispenser can in principle have any desired shape. Strongly rounded designs of the housing may be suitable in particular, since this means that the risk of injury is low in the event of someone inadvertently bumping into the dispenser.

Instead of the battery 27, an accumulator can also be used as the power source, or the dispenser can be powered directly from the mains via the socket 7.

The punched tapes 51 of the bag 13 from FIGS. 3 and 4 can also have more or fewer than the four illustrated columns 51.1, 51.2, 51.3, 51.4. The greater the number of columns, the more possible combinations there are, and the more identifications can be made. Correspondingly, the number of light barriers 9.1, 9.2, 9.3, 9.4 on the sensor 9 is also adapted to the number of columns of the punched tapes.

Moreover, instead of the flexible bag 13, it is also possible to use dimensionally stable containers as the liquid container. Likewise, the outlet tube can also be assembled as a component part of the bag 13 or of the liquid container.

It is also possible to use disinfecting solutions other than those mentioned with reference to FIGS. 3 and 4 (mixtures of povidone-iodine, chlorhexidine, ethanol, isopropanaol and/or n-propanol). The crucial point is that they have the best possible bactericidal, fungicidal, tuberculocidal and/or virus-inactivating effect.

It is likewise possible, for example, to omit the valve in the area of the outlet opening 21 of the outlet tube 19 and to dimension the outlet opening 21 in such a way that the liquid present in the outlet tube 19 is held back in the outlet tube 19 by adhesive and cohesive liquid forces and emerges only when pressure is applied to the outlet tube 19. This is suitable particularly in the case of liquids with higher viscosities, e.g. some soap solutions.

The time details mentioned with reference to FIGS. 10*a-f*, and concerning the overall time or the individual steps of the cleaning procedure, are dependent on which cleaning procedure is to be performed, which in turn is determined by the bag 13 inserted in the dispenser, and these times can accordingly also vary.

It will be stated in conclusion that a new type of dispenser has been created which makes it considerably easier to comply with hygiene standards. Moreover, incorrect actions taken when replacing the liquid container are effectively ruled out with the dispenser according to the invention since, each time liquid is dispensed, the sensor integrated in the dispenser automatically detects the identification of the liquid container inserted in the dispenser.

The invention claimed is:

1. An automatic dispenser for dispensing a liquid and for instructing a user, comprising:

a) a receiving device for a replaceable liquid container, wherein the receiving device has a sensor configured to read an identification of the replaceable liquid container;

b) a delivery device configured to permit the dispensing of the liquid from the liquid container;

c) one or more non-contact proximity detectors configured to detect a hand of the user, wherein the proximity detector is provided for initiating the dispensing of the liquid;

d) an output device configured for time-controlled output of a plurality of visual and/or sound-based instructions of a sequence of instructions to the user;

e) a control unit with at least one data memory, wherein the control unit is connected to the proximity detector, to the output device and to the sensor for identification of the replaceable container, and wherein a first data memory stores several sequences of instructions associated with different replaceable containers and/or with the identification thereof, wherein the control unit is configured, responsive to dispensing of the liquid by the delivery device, to retrieve from the first data memory a first sequence of instructions associated with the liquid container based on the signal of the sensor for reading the identification of the replaceable liquid container, and to transmit the first sequence of instructions to the output device, and the output device is configured to output the first sequence of instructions received from the control unit.

2. The automatic dispenser as claimed in claim 1, wherein the sensor is configured to detect a punched-hole code, such that a punched tape applied for identification of the liquid container can be read.

3. The automatic dispenser as claimed in claim 2, wherein the sensor comprises a plurality of light barriers arranged next to one another, wherein the light barriers are configured to receive the punched tape of the liquid container.

4. The automatic dispenser as claimed in claim 1, wherein the sensor is configured to detect a color code, such that a color pattern arranged as identification on the liquid container can be read.

5. The automatic dispenser as claimed in claim 1, wherein the sensor is configured to detect magnetic fields, such that one or more magnets arranged as identification on the liquid container can be detected.

6. The automatic dispenser as claimed in claim 1, wherein the sensor is configured to detect electromagnetic radiation, such that an electromagnetic transmitter arranged as identification on the liquid container can be read.

7. The automatic dispenser as claimed in claim 6, wherein the sensor is configured to detect an intensity of the electromagnetic radiation.

8. The automatic dispenser as claimed in claim 1, wherein the receiving device for the replaceable liquid container includes at least two securing devices which are arranged asymmetrically and/or are of different diameters and/or are of different shapes and which are provided for form-fit engagement in receiving openings of the replaceable liquid container and ensure an unambiguous arrangement of the replaceable liquid container in the dispenser.

9. The automatic dispenser as claimed in claim 8, wherein the at least two securing devices are circular retention pins.

10. The automatic dispenser as claimed in claim 1, wherein the output device is a liquid-crystal display.

11. The automatic dispenser as claimed in claim 9, wherein the liquid-crystal display has at least 1,024 separately controllable pixels.

12. The automatic dispenser as claimed in claim 9, wherein the sequences of instructions comprise instructions in the form of texts and images.

13. The automatic dispenser as claimed in claim 1, wherein the output device comprises a plurality of separately controllable light-emitting diodes, which are arranged next to different pictograms.

14. The automatic dispenser as claimed in claim 1, wherein the control unit is connected to at least one control button, which permits manual adjustment of user-specific preferences.

15. The automatic dispenser as claimed in claim 14, wherein the at least one control button permits adjustment of output formats of the sequences of instructions and display options of the output device.

16. The automatic dispenser as claimed in claim 14, wherein the user-specific preferences are stored retrievably in a second data memory.

17. The automatic dispenser as claimed in claim 1, wherein an electro-mechanically driven ram and a contact face lying opposite the electro-mechanically driven ram are arranged around a flexible outlet tube communicating with the liquid container, wherein the ram is provided for elastic deformation of the flexible outlet tube.

18. The automatic dispenser as claimed in claim 17, wherein the contact face can be displaced by a mechanical adjustment device in a direction of movement of the ram.

19. The automatic dispenser as claimed in claim 14, wherein the mechanical adjustment device comprises an adjustment screw that can be actuated by hand.

20. The automatic dispenser as claimed in claim 18, wherein proximity sensors are arranged on at least two opposite sides of an outlet opening of the outlet tube, such that the liquid from the liquid container communicating with the outlet tube is dispensed directly into the hand of the user independently of a direction of approach.

21. The automatic dispenser as claimed in claim 1, wherein the several sequences of instructions comprise individual instructions with time details concerning the performance of certain cleaning actions.

22. The automatic dispenser as claimed in claim 21, wherein the sequences of instructions comprise individual instructions concerning the cleaning and/or disinfecting of hands.

23. A method for dispensing a liquid from a replaceable liquid container and for instructing a user using an automatic dispenser, the method comprising the steps in the order of:

detecting, by a proximity detector, a hand of the user;

dispensing the liquid;

reading, by a sensor, an identification of the replaceable liquid container;

retrieving, by a control unit, from among several sequences of time-controlled instructions regarding the use of the dispensed liquid, the instructions being stored in a first data memory in the dispenser, a first sequence of instructions associated with the read identification of the liquid container based on the reading; and outputting, by an output device, the retrieved first sequence of instructions.

24. The method as claimed in claim 23, wherein reading comprises an identification of the replaceable liquid container in the form of a punched tape and the sensor comprises of a plurality of light barriers.

25. The method as claimed in claim 23, wherein outputting the retrieved sequence of instructions comprises presenting the sequence of instructions on a liquid-crystal display having at least 1,024 separately controllable pixels, as text information and image information.

26. The method as claimed in claim 23, wherein outputting the retrieved sequence of instructions comprises outputting the sequence of instructions by a plurality of chronologically controlled light-emitting diodes, which are arranged next to different pictograms on the dispenser.

27. The method as claimed in claim 23, wherein outputting the retrieved sequence of instructions comprises outputting individual instructions from the sequence of instructions in a time-controlled manner and step by step.

28. The method as claimed in claim 23, wherein dispensing comprises a cleaning liquid and/or a disinfecting solution.

29. The method as claimed in claim 23, wherein outputting with the sequence of instructions includes outputting information and/or directions concerning the performance cleaning actions, in particular directions concerning the cleaning and/or disinfecting of the user's hands.

* * * * *